United States Patent [19]

Kosuda et al.

[11] 4,438,738

[45] Mar. 27, 1984

[54] ROCKER ARM AND PROCESS FOR PRODUCING THE SAME

[75] Inventors: Hiroyuki Kosuda; Yasuo Kogo, both of Shizuoka; Yasuhiro Mishima, Aichi; Masahiro Nakagawa, Shizuoka, all of Japan

[73] Assignees: Toho Beslon Co., Ltd., Tokyo; Toyota Jidosha Kabushiki Kaisha, Aichi, both of Japan

[21] Appl. No.: 444,659

[22] Filed: Nov. 26, 1982

[30] Foreign Application Priority Data

Nov. 26, 1981 [JP] Japan ..... 56-189762
Nov. 26, 1981 [JP] Japan ..... 56-189763

[51] Int. Cl.[3] ..... F01L 1/18
[52] U.S. Cl. ..... 123/90.39; 74/579 E
[58] Field of Search ..... 123/90.39; 264/235, 264/236, 319; 74/579 E

[56] References Cited

U.S. PATENT DOCUMENTS 4,216,682 8/1980 Ban et al. ..... 74/579 E

OTHER PUBLICATIONS

Wise, Charles "Plastic Engine is Off and Running" Machine Design vol. 52, No. 10, May 8, 1980, pp. 24–26.

*Primary Examiner*—William R. Cline
*Assistant Examiner*—Peggy A. Neils
*Attorney, Agent, or Firm*—Sughrue, Mion, Zinn, Macpeak & Seas

[57] ABSTRACT

A rocker arm made from a carbon-fiber reinforced resin is disclosed wherein various axes are defined with particularity such as the central axis of the hole through which the rocker shaft is inserted (Z-axis), a line parallel to the edge of the valve side (Y-axis) and the line that is parallel to the cam side (Y'axis). The bisect of the angle at which the Y-axis crosses the Y'axis is the X-axis. Further, $\cos^2\beta$ of the carbon fibers present in the Y- or Y'axis side with respect to the X-Z axis is defined in detail where $\beta$ is a defined angle of orientation as is $\cos^2\alpha$ which is defined in the specification.

The rocker arm is produced by filling a rocker arm mold with a carbon fiber-containing synthetic resin such that $\cos^2\beta$ of the carbon fibers meets a defined value to such an extent that the $\cos^2\alpha$ meets a defind value. The rocker arm is lighter and stronger than conventional rocker arms.

22 Claims, 12 Drawing Figures

FIG. 1
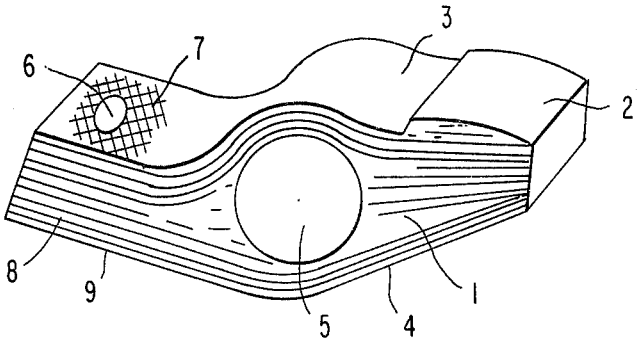
FIG. 2
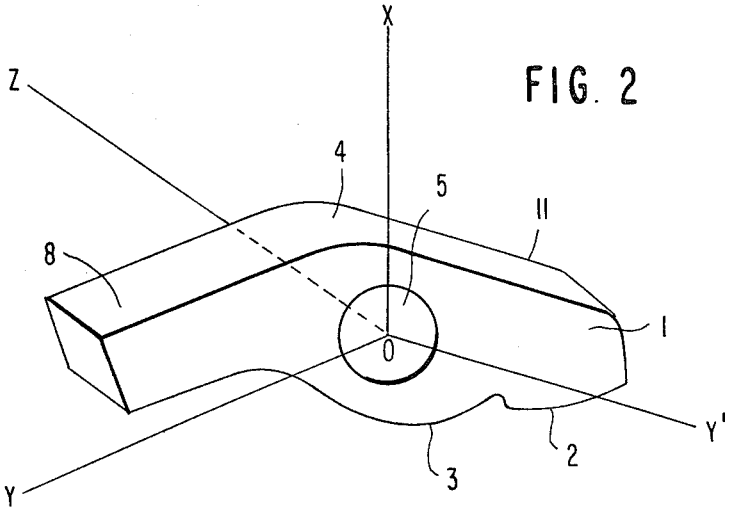
FIG. 3a
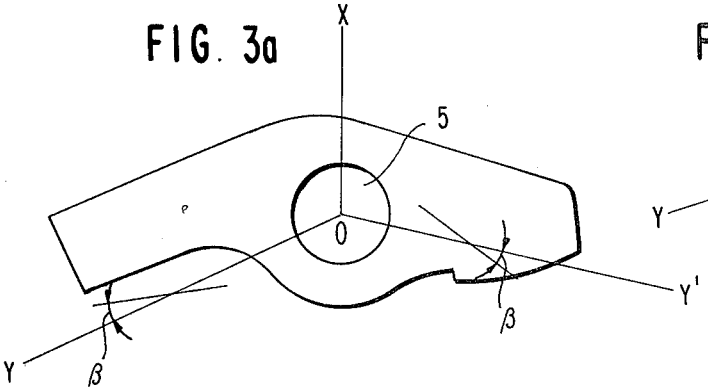
FIG. 3b
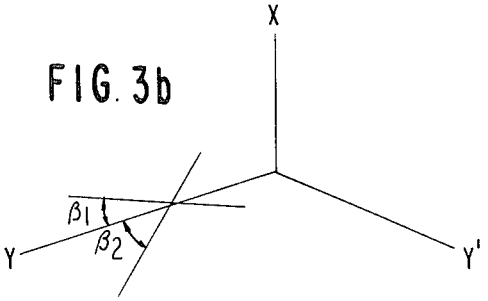
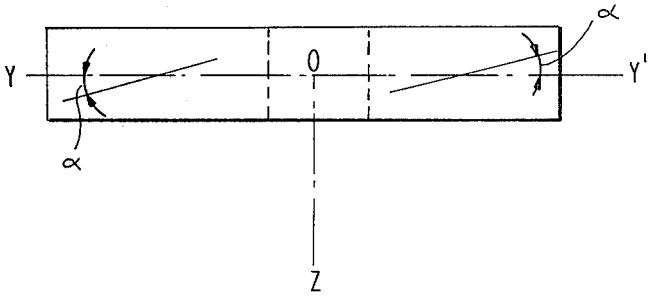
FIG. 4

ROCKER ARM AND PROCESS FOR PRODUCING THE SAME

FIELD OF THE INVENTION

The present invention relates to a lightweight rocker arm having a particularly defined inner structure which can be advantageously used in high-speed engines in that it is lighter and stronger than conventional iron rocker arms.

BACKGROUND OF THE INVENTION

In an attempt to improve the gas mileage, automotive engineers are making efforts to reduce car weight. One example of their efforts is to fabricate rocker arms with carbon fiber reinforced plastics (CFRP) in place of cast iron. Some of the inventors of the present invention have proposed a lightweight CFRP-made rocker arm in Japanese Utility Model Application (OPI) No. 103610/81 (the symbol OPI means an unexamined published Japanese patent or utility model application).

A rocker arm comprises two sides, one being connected to an engine valve by an adjusting screw and the other side communicates with a cam and a hole through which a rocker shaft is inserted. The first side is hereunder referred to as the valve side and the other side as the cam side. The valve side has an area on which the adjusting valve is mounted, and the cam side has a cam contact face. An example of the conventional rocker arm is illustrated in FIG. 1. During service, the rocker arm pivots on the rocker shaft and loads are applied at the adjusting screw mounting area and at the cam contact face.

In Japanese Utility Model Application (OPI) No. 103610/81, the rocker arm is made of a laminated sheet of prepregs wherein the fibers are oriented at an angle of ±45 degrees, and which are arranged in a direction perpendicular to the direction of stress application, or parallel to the axis of the rocker shaft. The rocker arm proposed in this reference has the desired strength and among other things, it is light weight and can be used advantageously in engines. However, the present inventors have found that the strength of this rocker arm is by no means sufficient for use in a high-speed engine because cracks sometimes developed at the interface between each prepreg when the engine was run under heavy load (i.e. at high speeds). This problem could not be completely solved by orienting fibers at different angles in two adjacent prepregs, or by changing the strength of carbon fibers or the proportion of carbon fibers in the plastics.

SUMMARY OF THE INVENTION

Therefore, an object of the present invention is to provide a strong and lightweight rocker arm and a process for producing the same.

The rocker arm of the present invention is comprised of a carbon-fiber reinforced resin wherein the central axis of the hole through which the rocker shaft is inserted is reference as the Z-axis. The line that is parallel to the surface of the valve side of the rocker arm opposite the surface having the cam contact face and which crosses the Z-axis at point 0 at a right angle is referenced as the Y-axis. The line that is parallel to the surface of the cam side of the rocker arm opposite the surface having the cam contact face and which crosses the Z-axis at point 0 at a right angle is referenced as the Y'-axis. The bisector of the angle YOY' is referenced as the X-axis. The rocker arm is constructed such that the $\overline{\cos^2 \beta}$, the average of the $\cos^2 \beta$ of the carbon fibers present on the Y-axis side with respect to the X-Z plane and those present on the Y'-axis side with respect to the X-Z plane, is not more than 0.9924. Wherein $\beta$ is the angle of orientation with respect to the Y-axis of the first group of fibers as they are projected onto the X-Y plane and the angle of orientation with respect to the Y'-axis of the second group of fibers as they are projected onto the X-Y' plane, and $\overline{\cos^2 \alpha}$, the average of $\cos^2 \alpha$ of the above-described two groups of fibers is not less than $\frac{3}{4}$, $\alpha$ being the angle of orientation with respect to the Y-axis of the first group of fibers as they are projected onto Z-Y plane or the angle of orientation with respect to the Y'-axis of the second group of fibers as they are projected onto Z-Y' plane.

The rocker arm of the present invention is produced by filling a rocker arm mold with carbon fibers and a synthetic resin in such a manner that the carbon fibers uniformly distributed in the resin and that the $\overline{\cos^2 \beta}$ of the carbon fibers is not more than 0.9924 and by heating the fiber-containing resin with pressure applied in the direction of Z-axis to such an extent that the $\overline{\cos^2 \alpha}$ of the carbon fibers is not less than $\frac{3}{4}$.

BRIEF DESCRIPTION OF THE DRAWINGS

FIG. 1 is a perspective view of a conventional rocker arm;

FIGS. 2 to 7 illustrate the theory of measuring the $\overline{\cos^2 \alpha}$ and $\overline{\cos^2 \beta}$ of the carbon fibers incorporated in the rocker arm of the present invention;

DETAILED DESCRIPTION OF THE INVENTION

Figure 5:
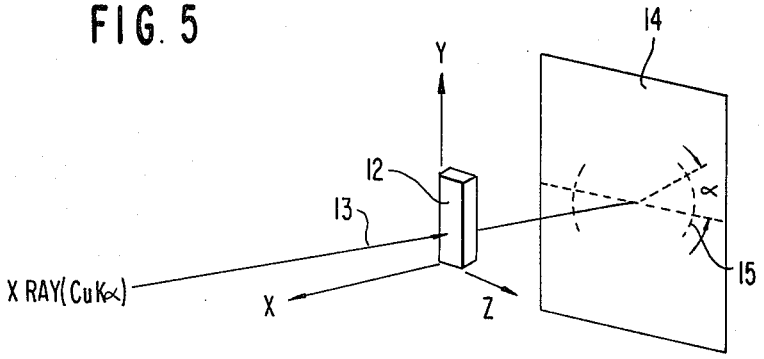

FIG. 1 is a perspective view of an example of a conventional rocker arm. As shown, the rocker arm consists of the cam side to (the right of the drawing) and the valve side (to the left of the drawing). It has two lateral sides (only one of which is shown at 1), a surface 3 having cam contact face 2, and the opposite surface 4. In the center of the lateral sides, a rocker shaft hole 5 is made through which there may be passed a rocker shaft. The surface 3 has on the valve side a hole 6 through which an adjusting screw that depresses the engine valve is thread. The rocker arm is made of a synthetic resin 8 reinforced with carbon fibers 7 in the form of prepregs 9 that are laminated as shown in FIG. 1.

The relation of the X-, Y-, Y'- and Z-axes as against the angles of fiber orientation $\alpha$ and $\beta$ is shown in FIGS. 2 to 4, wherein numerals 1 to 8 have the same definitions as those identified in FIG. 1. The Z-axis is referenced by the central axis of the hole 5 through which the rocker shaft is inserted. The Y-axis is referenced by the line that is parallel to the surface 10 of the valve side of the surface 4 and which crosses the Z-axis on point 0 at a right angle. The Y'-axis is referenced by the line that is parallel to the surface 11 of the cam side of the surface 4 and which crosses the Z-axis on point 0 at a right angle, and the X-axis is referenced by the line that passes point 0 to bisect the angle YOY'. The angles of orientation $\alpha$ and $\beta$ are indicated in FIGS. 3 and 4, respectively. In FIG. 3(*b*), if $\beta_1$ is a positive angle, $\beta_2$ on the opposite side with respect to the Y-axis is negative. The same principle will apply to the Y'-axis and angle $\alpha$. Therefore, it can be considered that $\alpha$ and $\beta$ are within the range of $-90° \sim 90°$.

Figure 6:
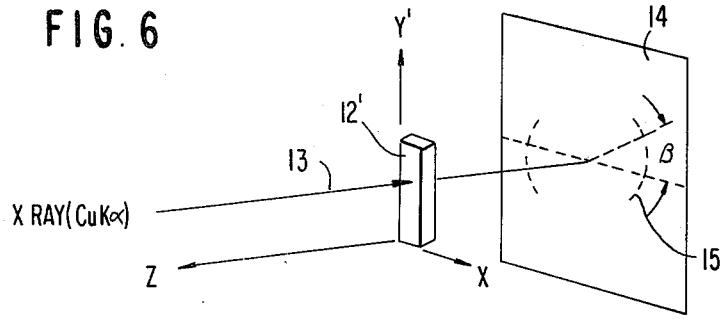
Figure 7:
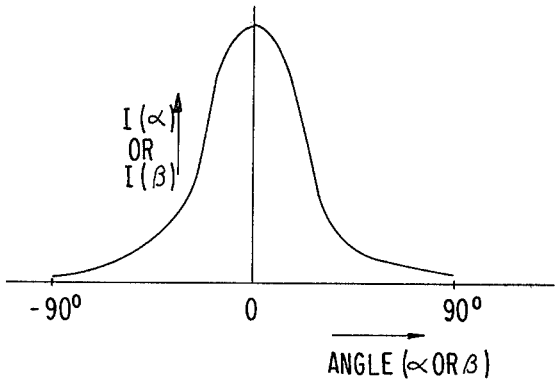

The method of determining $\overline{\cos^2 \alpha}$ and $\overline{\cos^2 \beta}$ is now described by reference to FIGS. 5 to 7. In FIGS. 5 and 6, numerals 12 and 12' represent samples cut from the specific rocker arm along the lines parallel to X-Y, X-Z and Y-Z planes (sample 12) or along the lines parallel to X-Y', X-Z and Y'-Z planes (sample 12'). The numeral 13 indicates the direction in which X-rays hit each sample, 14 is an X-ray film and 15 is an X-ray diffraction pattern. The curve of FIG. 7 shows the relation between the intensity of X-ray diffraction I($\alpha$) or I($\beta$) and the angle of orientation $\alpha$ or $\beta$. The intensity of X-ray diffraction is measured for a range of $-90° \leqq \alpha \leqq 90°$ and $-90° \leqq \beta \leqq 90°$ along the arc 15 of the diffraction pattern obtained for $2\theta = 25.5°$ (glancing angle or Blagg angle) in FIGS. 5 and 6, and the measured value is corrected against scattering due to air and noncrystallinity. From the intensity of X-ray diffraction I($\alpha$) and I($\beta$), $\overline{\cos^2 \alpha}$ and $\overline{\cos^2 \beta}$ can be calculated from the following formulae:

$$\overline{\cos^2\alpha} = \frac{\int_{-90}^{90} I(\alpha)\cos^2\alpha \cdot \sin\alpha \cdot d\alpha}{\int_{-90}^{90} I(\alpha)\sin\alpha \cdot d\alpha} \cdot \frac{1}{\cos^2\omega}$$

$$\overline{\cos^2\beta} \frac{\int_{-90}^{90} I(\beta)\cos^2\beta \cdot \sin\beta \cdot d\alpha}{\int_{-90}^{90} I(\beta)\sin\beta \cdot d\beta} \cdot \frac{1}{\cos^2\omega}$$

In the above formulae, $\omega$ represents the average orientation angle of graphite crystals in carbon fibers with respect to their fiber axes as measured by the same method as described above. For the purpose of the present invention, the value of each of $\overline{\cos^2 \alpha}$ and $\overline{\cos^2 \beta}$ is obtained by averaging the measurements for at least 20 points of one specific rocker arm.

If $\overline{\cos^2 \beta}$ is more than 0.9924, a crack will develop in a plane parallel to Z-Y or Z-Y' plane under high loads. $\overline{\text{Cos}^2 \beta}$ may assume a value down to zero, but if it is too small, the rocker arm also becomes less rigid, so the value of $\overline{\cos^2 \beta}$ is preferably not less than $\frac{1}{4}$. If $\overline{\cos^2 \alpha}$ is less than $\frac{3}{4}$, the rocker arm is no longer satisfactorily rigid and is subject to great dislocation under heavy loads, causing lower engine performance. $\text{Cos}^2\ \alpha$ is preferably from 1 to 0.9930. The fibers are preferably oriented in such a manner that the angle at which two fiber projected lines intersect is not less than 5 degrees on the average, rather than being oriented parallel to each other in the X-Y and X-Y' planes.

The carbon fibers to be used in the rocker arm of the present invention may be in any form such as chopped fibers, fabrics, felt and braiding provided they can be arranged to have the angles of orientation described above. Suitable chopped fibers are strands each comprising a bundle of 1,000, 3,000, 6,000, 12,000 or 24,000 carbon fiber filaments. They are usually cut to a length ranging from 5 mm to 100 mm. Preferably, their length is from 1/1 to 1/10 of the maximum length of the rocker arm in the direction of Y- or Y'-axis. For ease of handling and providing improved properties, a length from 10 mm to 50 mm is particularly preferred. So long as $\overline{\cos^2 \alpha}$ and $\overline{\cos^2 \beta}$ satisfy the prescribed requirements, the carbon fibers need not be substantially continuous from one end to the other. Instead, they may be in the form of fibers as short as 5–10 mm. The carbon fibers preferably have a diameter of 1 to 20$\mu$ a tensile strength of not less than 150 kg/mm and a tensile modulus of not less than 15,000 kg/mm$^2$.

Examples of the synthetic resin that is reinforced with the carbon fibers for use in the rocker arm of the present invention include thermosetting resins such as epoxy resins, polyimide resins, phenolic resins and unsaturated polyester resins, as well as thermoplastic resins such as polysulfone resins. Since the rocker arm is exposed to elevated temperatures during service, epoxy, polyimide, phenolic and polysulfone resins are particularly preferred. The CFRP rocker arm of the present invention usually contains 30 to 80%, preferably 45 to 75%, by volume of carbon fibers based on total amount of the carbon fiber reinforced resin.

The rocker arm of the present invention is fabricated by the following procedure. A rocker arm mold is first filled with carbon fibers in such a manner that $\overline{\cos^2 \beta}$ is not more than 0.9924 and then the fibers are impregnated with a synthetic resin. Alternatively, prepregs wherein a synthetic resin is impregnated with carbon fibers are charged in the mold in such a manner that the fibers are oriented in a direction to provide a value of $\overline{\cos^2 \beta}$ not more than 0.9924. If chopped carbon fibers are used, they are preferably placed in the X-Y and X-Y' planes so that $\overline{\cos^2 \beta}$ is not more than 0.9924. This can be achieved by random placement (fibers are placed in random orientation) of the chopped fibers. Using chopped fibers is preferred to lamination of prepregs in view of improved moldability and reduced cost.

When carbon fabric fiber or prepregs thereof are used, they are laminated in such a manner that $\cos^2 \alpha$ is not less than $\frac{3}{4}$, and preferably, they are laminated in such a manner that the surfaces thereof are placed in a direction perpendicular to the Z-axis. It is advantageous to cut the fabrics or the prepregs to the shape of each area of the rocker arm parallel to the X-Y and X-Y' planes and laminate them in the respective planes.

Figure 9:
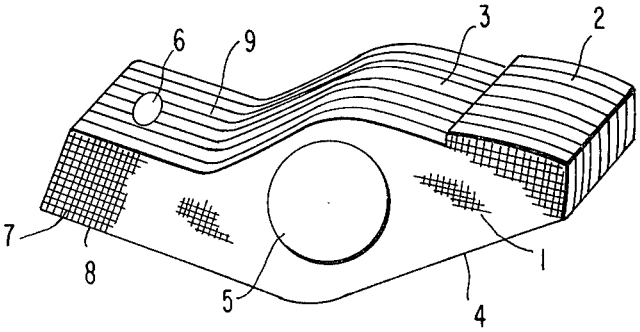

For the purpose of the present invention, both the warp and the weft of the carbon fiber fabric are generally made of carbon fibers strands. But either the warp or weft may be composed of glass fibers or a mixture of carbon fibers and glass fibers. The fabric may be in plain or satin weave. Carbon fibers may be oriented in any fashion in the fabric, but in a preferred mode, a layer wherein the warp (or weft) is made of carbon fibers arranged in the direction of Y-axis (as shown in FIG. 9) alternates with another layer wherein the warp (or weft) is made of carbon fibers arranged in the direction of Y'-axis.

If strand prepregs are used, they are preferably cut to a length between 1/1 and 1/10 of the maximum length of the rocker arm and laminated in the X-Y and X-Y' planes. It is preferable to arrange the prepregs with the angle of orientation $\beta$ varied over a range where $\overline{\cos^2 \beta}$ of the fibers is not less than 0.9924.

The carbon fiber-containing synthetic resin in the mold is then applied a pressure in the direction of the Z-axis to such an extent that $\overline{\cos^2 \alpha}$ is not less than $\frac{3}{4}$. If the synthetic resin is thermoplastic, heating is necessary upon pressing. The preferred heating temperature ranges from the softening or melting point of the resin to its decomposition point If the resin is thermosetting, it may be first precured by heating before compression, or both heating and compression may be effected at the same time. Heating may follow the application of pressure, but more preferably, precuring by heating precedes the pressure application. Compression is effected until air bubbles are no longer present in the mold and $\overline{\cos^2\alpha}$ of the fibers is at least $\frac{3}{4}$. The pressure is usually applied in a range of from 1 kg/cm$^2$ to 100 kg/cm$^2$.

Figure 8:
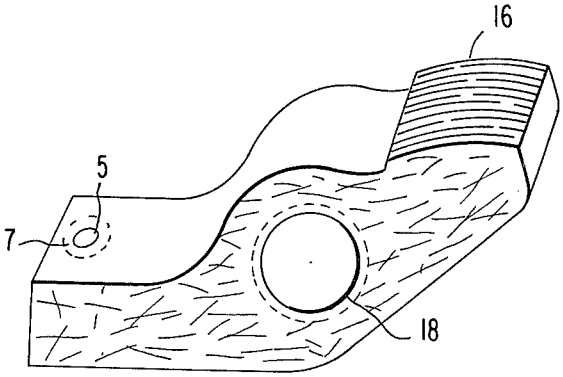
FIGS. 8 and 9 are perspective views showing two embodiments of the rocker arm of the present invention.

A metal insert element may be inserted in the cam contact face, the adjusting screw mounting area and through the circumference of the rocker shaft hole as shown in FIG. 8. As the engine runs, the rocker arm pivots on the rocker shaft with the result that the cam contact face and adjusting screw mounting area are subject to bending and shear stresses. The cam contact face is placed under a higher load and must withstand faster movement. Therefore, cam pads are inserted in that area and they are preferably made of a hard and wear-resistant metallic material such as cast iron. If necessary, a metallic, for example, aluminum insert 17 may be embedded in the adjusting screw mounting area, bored and threaded. During service, the rocker arm pivots rapidly on the rocker shaft with high surface pressure applied thereto, so to prevent any trouble from occurring due to high PV value (product of pressure and velocity) exceeds the critical PV of the rocker arm material (beyond which the rocker arm is no longer operable), a metallic bush 18 having a high critical PV value may be inserted in the circumference of the rocker shaft hole.

Provision of these metallic elements can be effected simultaneously with the molding of the rocker arm by Placing these inserts at proper positions in the mold and then filling the mold with carbon fibers and a resin or prepregs together followed by compression molding. By arranging the carbon fibers in such a manner that the average angles of orientation $\alpha$ and $\beta$ satisfy the prescribed values, the rocker arm of the present invention has a greater strength than the conventional product and can be used in a high-speed engine without developing a crack at any interface of laminations. According to the process of the present invention, not only the average angle of orientation $\alpha$ but also the average angle of orientation $\beta$ can be adjusted to the desired value, and hence, a rocker arm having improved strength can be fabricated.

The present invention is now described in greater detail by reference to the following examples and comparative examples which are given here for illustrative purposes only and are by no means intended to limit the scope of this invention.

EXAMPLE 1

Carbon fiber strands each comprising a bundle of 6,000 filaments of which trade name is HTA-7-6000 manufactured by Toho Beslon Co., Ltd.; diameter of 7$\mu$, tensile strength 350 kg/cm$^2$, tensile modulus: 24,000 kg/mm$^2$ were impregnated with Q 1101 Epoxy Resin (trade name, a epoxy resin manufactured by Toho Beslon Co., Ltd.) to prepare strands of prepreg, which contained 42 wt% of the epoxy resin. They were chopped to shorter strands of a length of 3 cm, and supplied to a rocker arm mold (maximum length along Y- and Y'-axes: 8 cm) in the direction of Z-axis and packed in such a manner that they were randomly oriented in the X-Y and X-Y' planes. The mold was set in a hot press. The prepreg was precured by heating at 130° C. for 60 minutes, and subsequently, heated at 180° C. for a period of 120 minutes with a pressure of 7 kg/cm$^2$ applied in the direction of the Z-axis. The mold was cooled, the molding was taken out of it and a rocker shaft hole was bored with a superhard drill to thereby produce a rocker arm as the final product. The carbon fibers in the rocker arm had a $\overline{\cos^2\beta}$ of 0.883 and a $\overline{\cos^2\alpha}$ of 0.933. The fiber content was 55 vol%. The width and weight of the rocker arm, as well as three parameters of its performance are listed in Table 1 together with the corresponding data of a conventional product made of cast iron. One can see from the table that the weight of the rocker arm of the present invention was less than half the weight of the conventional product and yet, the former had much improved strength properties over the latter.

EXAMPLE 2

Carbon fiber strands each comprising a bundle of 12,000 filaments (HTA-7-12000 of Toho Beslon Co., Ltd. with a diameter of 7$\mu$, a tensile strength of 350 kg/cm 2 and a tensile modulus of 24,000 kg/mm) were chopped to a length of about 3 cm. The chopped strands were supplied to a rocker arm mold (of the same dimensions as in Example 1) in the direction of the Z-axis and packed in such a manner that they were randomly oriented in the X-Y and X-Y' planes. At the same time, a cam pad made of cast iron was placed at the cam contact face, a round aluminum bar (16 mm$\phi$) at the adjusting screw mounting area and an aluminum pipe (inner diameter: 16 mm, outer diameter: 22 mm) in the circumference of the rocker shaft hole.

The aluminum pipe was held in position by a round bar (16 mm$\phi$) supported on the mold on both ends. The carbon fibers were then impregnated with Q-1101 epoxy resin to a resin content of 42 wt%. The mix was cured under the same conditions as used in Example 1, and cooled. After demolding, a rocker arm with three metallic inserts was obtained. The product had a resin content of 55 vol%, $\overline{\cos^2\alpha}$ of 0.957 and $\overline{\cos^2\beta}$ of 0.970. The width and weight of the rocker arm, as well as three parameters of its performance are listed in Table 1, from which one can see that the weight of the rocker arm of the present invention was about half that of the conventional product and that yet the strength of the former was almost doubled.

COMPARATIVE EXAMPLE 1

A rocker arm was produced as in Example 1 except that a mold was packed with prepregs of chopped strands which were arranged randomly in Z-Y and Z-Y' planes and that the prepregs were cured with a pressure applied in the direction of the X-axis. The final product had $\overline{\cos^2\alpha}$ of 0.883 and $\overline{\cos^2\beta}$ of 0.997, the latter being outside the range specified for the present invention. The width and weight of the rocker arm, as well as three parameters of its performance are listed in Table 1, from which one can see that the weight of the rocker arm was less than half the weight of the conventional product but that the former was weak and broke under a very small load. This is because the carbon fibers were not oriented in the direction of X-axis (width of the rocker arm) and the rocker arm was unable to sustain shear stress.

COMPARATIVE EXAMPLE 2

A prepreg made of an epoxy resin (Q-1102 Epoxy Resin manufactured by Toho Beslon Co., Ltd.) and carbon fibers (the same as in Example 1) oriented at ±45 degrees. The resin content was 42 wt%, the prepreg consisted of two elements in which the fibers were oriented in one direction and were laminated in such a manner that the respective directions or orientation were ±45 degrees with respect to their length). The prepreg was cut to the cross sections of individual parts of a rocker arm parallel to Y-Z and Y'-Z planes. To provide the predetermined thicknesses, the prepreg was cut to gradually varying shapes, and the individual cuts were laminated so that no sudden change would take place in thickness. The laminated prepregs were placed in a rocker arm mold which were set in a hot press. The prepregs were cured by pressing in the direction of X-axis at 180° C. and 5 kg/cm$^2$ for 120 minutes as in Example 1 to produce a rocker arm as illustrated in FIG. 1. The product had a fiber content of 55 vol%, and had $\cos^2 \alpha$ of 0.5 and $\overline{\cos^2 \beta}$ of 1.0, both being outside the range defined for the present invention. The width and weight of the rocker arm, as well as three parameters of its performance are shown in Table 1, from which one can see that the weight of the comparative sample was less than half the weight of the conventional product but that the former was weak and failed under a very small load.

TABLE 1

| | Example | | Comparative Example | | Conventional |
|---|---|---|---|---|---|
| | 1 | 2 | 1 | 2 | product |
| Rocker arm width (mm) | 22 | 22 | 22 | 22 | 22 |
| Rocker arm weight (g) | 52 | 59 | 51 | 55 | 110 |
| Displacement of cam side under 400 kg load (mm) | 0.30 | 0.28 | 0.29 | 0.67 | 0.18 |
| Breaking load (kg) | 1470 | 1580 | 605 | 430 | 880 |
| Break mode | bending | bending | inter laminar shear | inter laminar shear | bending |

*The conventional product was made of cast iron.

EXAMPLE 3

A prepreg made of a satin fabric (380 g/m$^2$) of carbon fibers and epoxy resin (the same carbon fibers and the resin as Example 1, the resin content of the prepreg was 50 wt%) was cut to the cross sections of 61 individual parts of a rocker arm perpendicular to the rocker shaft. The resulting cuts were laminated in a direction perpendicular to the axis of the rocker shaft, and the laminated prepregs were placed in a rocker arm mold which was set in a hot press. The prepregs were precured by heating at 130° C. for 60 minutes, and subsequently, heated to 180° C. and compressed in the Z-axis direction at 7 kg/cm$^2$ for 120 minutes. The mold was cooled, the molding was taken out of it and a rocker shaft hole was bored with a drill to thereby produce a rocker arm as illustrated in FIG. 9, wherein the numerals 1 to 9 have the same definitions as those identified in FIG. 1. The fiber content was 50 vol%. The weight of the rocker arm, as well as three parameters of its performance are listed in Table 2 together with the corresponding data of a conventional product made of cast iron. One can see from the talbe that although the weight of rocker arm of the present invention was less than half the weight of the conventional product, the former was at least twice as strong as the latter.

EXAMPLE 4

A prepreg made of a plain fabric (200 g/m$^2$) of carbon fibers and an epoxy resin (the same carbon fibers and the epoxy resin as Example 1) were used. The resin content was 50 wt%. The prepreg was cut to cross sections of 116 individual parts of a rocker arm perpendicular to the rocker shaft. A hole whose radius was 3 mm larger than that required for inserting the rocker shaft was bored near the center of each cut. The resulting prepregs were laminated in a direction perpendicular to the axis of the rocker shaft. A cam pad of cast iron was inserted in the cam contact face in the direction of the thickness of the cam side. A hole having a diameter of 16 mm was made in the adjusting screw mounting area of the valve side and a round aluminum bar (outer diameter: 16 mm) with threaded grooves was inserted in that hole. An aluminum pipe was fit into the rocker shaft hole. With these metallic inserts, an assembly of the prepregs was placed in a rocker arm mold, cured as in Example 3, and cooled. After demolding, a rocker arm was obtained. The fiber content of the thus obtained product was 50 vol%. Its weight and three parameters of its performance are listed in Table 2, from which one can see that although the weight of the rocker arm of the present invention was almost half the weight of the conventional product, the former was stronger than the latter.

COMPARATIVE EXAMPLE 3

A prepreg the same as used in Example 3 was cut to the size of sections parallel to the Y-Z and Y'-Z planes of a rocker arm. The prepreg was cut to gradually varying shapes, and the individual cuts were laminated so that no sudden change would occur in thickness. The laminated prepregs were placed in a rocker arm mold, cured as in Example 3 with the exception in that it was pressed in X axis direction cooled and demolded. A hole through which the rocker shaft could pass was bored in the molding to thereby provide a rocker arm. The fiber content of the thus obtained product was 50 vol% weight and three parameters of its performance are noted in Table 2, from which one can see that the comparative sample was far weaker than the samples prepared in Examples 3 and 4 according to the present invention.

TABLE 2

| | Example 3 | Example 4 | Comparative Example 3 | Conventional product* |
|---|---|---|---|---|
| Rocker arm weight (g) | 51 | 61 | 52 | 110 |
| Displacement of cam side under 400 kg load (mm) | 0.30 | 0.29 | 0.24 | 0.18 |
| Breaking load (kg) | 2053 | 1005 | 480 | 880 |
| Break mode | bending | All insert slipped off | Inter-laminar shear | bending |

*The conventional product was made of cast iron.

Figure 10:
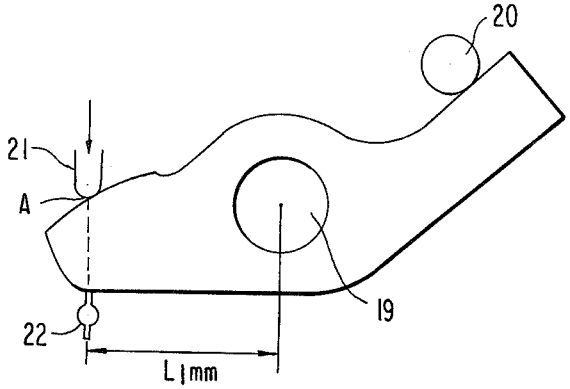
FIG. 10 illustrates the method of measuring the dislocation under load of the rocker arms prepared in the Examples and Comparative Examples.

Testing Procedure (1) Displacement of cam side: As shown in FIG. 10, the rocker arm was fixed by shafts 19 and 20, and as a load of 400 kg was applied at point A by an loading nose 21, the resulting displacement of the rocker arm on the cam side was measured with a dial gauge 22. In the test, $L_1$ was 27 mm.

Figure 11:
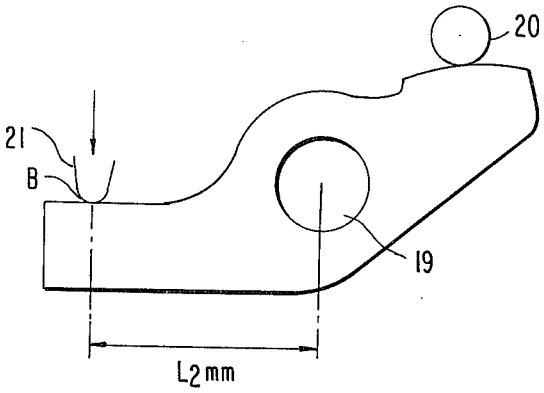
FIG. 11 depicts the method of measuring the breaking load for the rocker arms of the Examples and Comparative Examples.

(2) Valve side breaking load: As shown in FIG. 11, the rocker arm was fixed by shafts 19 and 20 and a gradually increasing load was applied to point B by an loading nose 21 until the valve side of the rocker arm failed. In this test, $L_2$ was 35 mm.

While the invention has been described in detail and with reference to specific embodiment thereof, it will be apparent to one skilled in the art that various changes and modifications can be made therein without departing from the spirit and scope thereof.

What is claimed is:

1. A rocker arm made from a carbon-fiber reinforced resin wherein the central axis of a rocker shaft hole through which the rocker shaft is inserted is referenced as Z-axis, a line parallel to a surface of a valve side of the rocker arm opposite a surface having a cam contact face and which crosses the Z-axis at point 0 at a right angle, is referenced as a Y-axis, the line that is parallel to the surface of the cam side of the rocker arm opposite the surface having the cam contact face and which crosses the Z-axis at point 0 at a right angle is referenced as a Y'-axis, and the bisector of the angle YOY' is referenced as a X-axis, and wherein $\overline{\cos^2\beta}$, the average of $\cos^2\beta$ of the carbon fibers present on the Y-axis side with respeact to a X-Z plane and carbon fibers present on the Y'-axis side with respect to X-Z plane, is not more than 0.9924, $\beta$ being the angle of orientation with respect to the Y-axis of a first group of fibers as the fibers are projected onto the X-Y plane and the angle of orientation with respect to the Y'-axis of the second group of fibers as they are projected onto the X-Y' plane, and $\overline{\cos^2\alpha}$, the average of $\cos^2\alpha$ of the first group of fibers and second group of fibers is not less than $\frac{3}{4}$, $\alpha$ being the angle of orientation with respect to the Y-axis of the first group of fibers as they are projected onto Z-Y plane and the angle of orientation with respect to the Y'-axis of the second group of fibers as they are projected onto Z-Y' plane.

2. A rocker arm according to claim 1 wherein $\cos^2\beta$ is from 0.9924 to 0.25.

3. A rocker arm according to claim 1 wherein $\cos^2\alpha$ is from 1 to 0.9930.

4. A rocker arm according to claim 1 wherein two carbon fiber projected lines in X-Y and X-Y' planes intersect each other at an angle of not of less than an average of 5 degrees.

5. A rocker arm according to claim 1 wherein the carbon fibers are 5 to 100 mm long.

6. A rocker arm according to claim 1 wherein the carbon fibers are 10 to 50 mm long.

7. A rocker arm according to claim 1 wherein the length of the carbon fibers is from 1/1 to 1/10 of the maximum length of the rocker arm in the direction along the Y- and Y'-axis.

8. A rocker arm according to claim 1 wherein the carbon fibers are chopped fibers.

9. A rocker arm according to claim 1 wherein the carbon fibers are in the form of fabrics, felt of braiding.

10. A rocker arm according to claim 1 wherein the carbon fibers have a diameter of from 1 to 20$\mu$.

11. A rocker arm according to claim 1 wherein the carbon fibers have a tensile strength of more than 150 kg/mm$^2$.

12. A rocker arm according to claim 1 wherein the carbon fibers have a tensile modulus of more than 15,000 kg/mm$^2$.

13. A rocker arm according to claim 1 wherein the resin used in the carbon-fiber reinforced resin is a heat-cured thermosetting resin.

14. A rocker arm according to claim 13 wherein the thermosetting resin is selected from the group consisting of epoxy resins, polyimide resins, phenolic resins and polyester resins.

15. A rocker arm according to claim 1 wherein the resin used in the carbon-fiber reinforced resin is a thermoplastic resin.

16. A rocker arm according to claim 15 wherein the thermoplastic resin is a polysulfone resin.

17. A rocker arm according to claim 1 wherein the carbon-fiber reinforced synthetic resin is filled with 30 to 80% by volume of the carbon fibers.

18. A rocker arm according to claim 8, wherein the carbon fibers placed in the X-Y and X-Y' planes are in a random orientation.

19. A rocker arm according to claim 9, wherein fabrics are laminated in a direction perpendicular to the Z-axis.

20. A rocker arm according to claim 1, wherein the rocker arm has a metal insert element inserted in the cam contact face, the adjusting screw mounting area or the circumference of the rocker shaft hole.

21. A process for producing a rocker arm made of carbon-fiber reinforced synthetic resin, comprising packing a rocker arm mold with carbon fibers and a synthetic resin in such a manner that $\cos^2\beta$, the average $\overline{\cos^2\beta}$ of the carbon fibers present on the Y-axis side with respect X-Z plane and carbon fibers present on the Y'-axis side with respect X-Z plane, is not more than 0.9924, $\beta$ being the angle of orientation with respect to the Y-axis of the first group of fibers as they are projected onto a X-Y plane and the angle of orientation with respect to the Y'-axis of the second group of fibers as they are projected onto the X-Y' plane, and heating and pressing the packed material in the direction of a Z-axis in such a manner that $\overline{\cos^2\alpha}$, the average of $\overline{\cos^2\alpha}$ of the first group of fibers and second group of fibers is not less than $\frac{3}{4}$, $\alpha$ being the angle of orientation with respect to the Y-axis of the first group of fibers as projected onto a Z-Y plane and the angle of orientation with respect to the Y'-axis of the second group of fibers as they are projected onto a Z-Y' plane, Z-axis being the central axis of the hole through which the rocker shaft is inserted. Y-axis being the line that is parallel to a surface of a valve side of the rocker arm opposite a surface having a cam contact face and which crosses the Z-axis at a point 0 at a right angle, Y'-axis being a line parallel to a surface of a cam side on a surface of the rocker arm opposite the surface having the cam contact face and which crosses the Z-axis at the point 0 at a right angle, and an X-axis being the bisector of the angle YOY'.

22. A process for producing a rocker arm according to claim 21, wherein a metal insert element is provided to the rocker arm simultaneously with the molding of the rocker arm.

* * * * *